US008118634B2

(12) United States Patent
Forti

(10) Patent No.: US 8,118,634 B2
(45) Date of Patent: Feb. 21, 2012

(54) METHOD AND APPARATUS FOR NEAR-INVISIBLE TETHERS

(75) Inventor: William Mark Forti, Claremont, CA (US)

(73) Assignee: William Mark Corporation, Claremont, CA (US)

( * ) Notice: Subject to any disclaimer, the term of this patent is extended or adjusted under 35 U.S.C. 154(b) by 582 days.

(21) Appl. No.: 12/111,895

(22) Filed: Apr. 29, 2008

(65) Prior Publication Data

US 2009/0176434 A1 Jul. 9, 2009

Related U.S. Application Data

(60) Provisional application No. 61/019,174, filed on Jan. 4, 2008.

(51) Int. Cl.
*A63H 27/04* (2006.01)

(52) U.S. Cl. ..... 446/28; 446/26; 446/30; 446/31; 446/32; 446/34; 273/317; 273/329; 273/331

(58) Field of Classification Search ..... 446/24, 446/26, 28, 30–32, 34; 273/326, 317, 329, 273/331
See application file for complete search history.

(56) References Cited

U.S. PATENT DOCUMENTS 1,153,155 A * 9/1915 Fritsch ..... 446/30
1,538,217 A * 5/1925 Sears ..... 446/228
2,219,831 A * 10/1940 Winter ..... 446/228
2,469,058 A * 5/1949 Sullivan ..... 446/228
2,561,760 A * 7/1951 Stifter ..... 446/30
2,593,979 A * 4/1952 Calhoun ..... 244/154
2,601,409 A * 6/1952 McArthur et al. ..... 242/396.1
2,921,743 A * 1/1960 Westover et al. ..... 239/723
2,947,108 A * 8/1960 Dodd, Jr. et al. ..... 446/30
2,958,156 A * 11/1960 Schmahl et al. ..... 446/27
2,968,119 A * 1/1961 Glass et al. ..... 446/33
3,030,733 A * 4/1962 Crawford ..... 446/30
3,107,452 A * 10/1963 Berger ..... 446/30
3,138,356 A 6/1964 McClain
3,161,988 A * 12/1964 Junker ..... 446/31
3,600,843 A * 8/1971 Becker ..... 446/228
3,787,013 A * 1/1974 McKenzie, Sr. ..... 244/155 R
3,802,117 A * 4/1974 Engelhardt ..... 446/46
3,844,557 A * 10/1974 Pompetti ..... 463/58
3,858,872 A 1/1975 Summerfield et al.
3,976,297 A * 8/1976 Seymour ..... 273/335
3,991,512 A * 11/1976 Stanzel ..... 446/33
3,997,136 A 12/1976 Finn et al.
4,135,711 A * 1/1979 Holt ..... 472/10
4,157,631 A 6/1979 Kifferstein et al.
4,159,087 A * 6/1979 Moomaw ..... 244/153 R
4,257,186 A * 3/1981 Wilson ..... 446/30
4,297,808 A * 11/1981 D'Andrade ..... 446/30
4,457,098 A * 7/1984 Tsuzuki ..... 446/435
4,664,389 A * 5/1987 Barclay et al. ..... 273/343
(Continued)

*Primary Examiner* — Gene Kim
*Assistant Examiner* — Alexander Niconovich
(74) *Attorney, Agent, or Firm* — Fish & Associates, PC

(57) ABSTRACT

One or more ready-to-use near-invisible fixed-length tethers are provided on a carrier such that each tether can be removed from and reattached to the carrier without tangling. Most typically, such attachment is facilitated by modifying the ends of the tethers with a low tack adhesive and by winding the tether around a spool portion. Especially preferred low-tack adhesives provide adhesion of the tether ends to a user, the carrier, and the toy. In particularly preferred aspects, the tether is attached such that one end is removable while the other end remains attached such that the tether can be unwound from the spool by inverting the carrier.

13 Claims, 3 Drawing Sheets

U.S. PATENT DOCUMENTS 4,715,564 A * 12/1987 Kinn et al. ..... 244/153 R
4,802,875 A * 2/1989 Cunningham ..... 446/46
4,915,394 A * 4/1990 Kramer ..... 273/330
4,930,448 A * 6/1990 Robinson ..... 119/708
4,981,456 A * 1/1991 Sato et al. ..... 446/36
4,982,641 A * 1/1991 Duhart ..... 84/329
5,118,054 A * 6/1992 Kirschenbaum et al. . 244/153 R
5,148,769 A * 9/1992 Zelinger ..... 119/708
5,188,314 A * 2/1993 Peters ..... 244/31
5,254,077 A * 10/1993 Nottingham et al. ..... 446/48
5,467,740 A * 11/1995 Redwine ..... 119/707
5,474,032 A * 12/1995 Krietzman et al. ..... 119/708
5,505,161 A * 4/1996 Swendseid ..... 119/708
5,547,413 A * 8/1996 Murray ..... 446/220
5,634,839 A * 6/1997 Dixon ..... 446/37
5,709,580 A * 1/1998 Stanzel ..... 446/31
5,765,831 A * 6/1998 Huffhines ..... 273/348.4
5,816,877 A * 10/1998 Chuang ..... 446/31
5,837,913 A * 11/1998 Newman ..... 84/329
5,875,737 A * 3/1999 Boshears ..... 119/706
5,924,387 A * 7/1999 Schramer ..... 119/708
6,016,771 A * 1/2000 Baiera et al. ..... 119/708
6,019,661 A * 2/2000 Simpkins ..... 446/228
6,076,758 A * 6/2000 Kieves et al. ..... 242/400.1
6,135,388 A * 10/2000 Hostetter ..... 244/153 R
6,250,526 B1 * 6/2001 Bess ..... 224/275
6,283,816 B1 * 9/2001 Pascual ..... 446/34
6,314,913 B1 * 11/2001 Lettau et al. ..... 119/707
6,318,300 B1 * 11/2001 Renforth et al. ..... 119/708
6,401,665 B1 * 6/2002 Gentile ..... 119/707
6,443,397 B1 * 9/2002 Morris ..... 244/153 R
6,572,482 B1 * 6/2003 Lewis, Jr. ..... 472/9
6,581,879 B2 * 6/2003 Bellacera ..... 244/155 A
6,582,272 B1 * 6/2003 Nelson et al. ..... 446/220
6,631,811 B2 * 10/2003 Komar et al. ..... 211/13.1
6,663,460 B1 * 12/2003 Nelson ..... 446/220
6,684,819 B1 * 2/2004 Locke ..... 119/707
6,845,737 B1 * 1/2005 Austin ..... 119/796
6,962,309 B1 * 11/2005 Chang ..... 244/155 R
7,044,084 B2 * 5/2006 Ritchey ..... 119/707
7,104,861 B2 * 9/2006 Kanahele et al. ..... 446/26
7,246,574 B2 * 7/2007 Renforth ..... 119/711
7,311,578 B2 * 12/2007 Stanley et al. ..... 446/26
2001/0034176 A1 * 10/2001 Deliu ..... 446/26
2002/0173216 A1 * 11/2002 Abel ..... 446/26
2003/0045202 A1 * 3/2003 Komar et al. ..... 446/221
2003/0124950 A1 * 7/2003 Turner ..... 446/236
2006/0054105 A1 * 3/2006 Renforth et al. ..... 119/708
2006/0054106 A1 * 3/2006 Renforth ..... 119/711
2006/0157622 A1 * 7/2006 Johnston et al. ..... 244/154
2006/0183396 A1 * 8/2006 Kanahele et al. ..... 446/26
2006/0217027 A1 * 9/2006 Martuccio ..... 446/46
2006/0266299 A1 * 11/2006 DiAntonio ..... 119/708
2006/0292959 A1 * 12/2006 Greenwald et al. ..... 446/220
2007/0119384 A1 * 5/2007 Ritchey ..... 119/708
2007/0283899 A1 * 12/2007 Genitrini ..... 119/708
2008/0076322 A1 * 3/2008 Phillips ..... 446/220
2008/0085655 A1 * 4/2008 Boise ..... 446/220
2008/0085656 A1 * 4/2008 Boise ..... 446/220
2009/0176433 A1 * 7/2009 Forti ..... 446/26
2009/0205580 A1 * 8/2009 Tiefel ..... 119/708

* cited by examiner

METHOD AND APPARATUS FOR NEAR-INVISIBLE TETHERS

This application claims priority to our copending U.S. provisional application with the Ser. No. 61/019174, which was filed Jan. 4, 2008.

FIELD OF THE INVENTION

The field of the invention is visible or near-invisible tethers for toys and entertainment devices.

BACKGROUND OF THE INVENTION

There are numerous toys and 'magic tricks' known in the art in which one or more objects are suspended in the air using a visible or near-invisible tether. For example, mobiles or small airplanes often use visible relatively thick tethers to control the path of the suspended object or airplane. While such thick tethers advantageously secure the object or airplane in a robust manner and even allow significant forces on the object or airplane, the tether typically precludes the illusion of free flight or levitation.

On the other hand, many 'magic tricks' rely on a near-invisible tether to suspend an object in the air that one would not expect to fly or levitate. However, and especially where such tethers are very thin, manufacture, storage, and performance are often problematic. For example, near-invisible tethers are typically monofilaments or thin filament bundles having a thickness of about 10-80 microns, making controlled handling very difficult due to the very low tensile strength and tendency to tangle. Moreover, such tethers are generally not available as a commodity and must be prepared by unwinding from a multi-filament yarn, which requires considerable dexterity, attention span, and time commitment. Still further, attachment of the tether to the object is often complicated due to the near-invisible nature of the tether. Therefore, set-up for 'magic tricks' that rely on such tethers is often cumbersome and typically precludes small children (e.g., 10 years and younger) from such entertainment.

Therefore, while numerous methods for tethered entertainment devices are known in the art, all or almost all of them suffer from one or more disadvantages. Most notably, known near-invisible tethers are notoriously difficult to handle due to their tendency to tangle, to resist stable knot formation, and electrostatic cling. Consequently, there is still a need to provide simplified kits and methods for improved handling of near-invisible tethers.

SUMMARY OF THE INVENTION

The present invention is drawn to methods and devices in which one or more tethers are provided and releasably attached to a carrier such that the tether can be removed from and reattached to the carrier without tangling. Most preferably, attachment of the tether is facilitated by a low-tack adhesive. Such devices greatly facilitate handling of near-invisible tethers, which so allows use of such tethers by even small children.

Therefore, in one especially preferred aspect of the inventive subject matter, method of reducing set-up time for an entertainment device will include the steps of (a) preparing a near-invisible fixed-length tether, (b) modifying at last one end of the tether with a low-tack adhesive, (c) coupling the modified tether to a carrier that comprises a spool using the low-tack adhesive to form a tether-spool assembly that allows removal of the tether from the spool prior to use, (d) advising (e.g., via pictorial, written, or electronically display) that the tether can be coupled to an object to thereby provide the illusion of flight, and (e) offering the tether-spool assembly for sale. Most typically, contemplated near-invisible fixed-length tethers will have a diameter of less than 50 microns, and/or a length of between 20 cm and 100 cm.

Most preferably, contemplated methods will further include a step of a step of advising that removal of the tether comprises a step of removing the at least one end of the tether from the carrier while maintaining another end of the tether coupled to the carrier, and optionally a step of advising to invert the carrier while the another end remains coupled to the carrier. In further preferred aspects, another end of the tether is modified with the low-tack adhesive, and attaching the other end of the tether to the carrier via the low-tack adhesive. Where desired, the carrier is further configured to accommodate a light-weight toy, and wherein the light-weight toy is coupled to the carrier, and/or the light-weight toy is packaged together with the carrier. In especially preferred aspects, the light-weight toy comprises a mechanism that imparts appearance of plausible possibility of flight to the toy without providing sufficient lift or propulsion for flight. For example, the mechanism may be a fixed airfoil, a movable airfoil, and/or a propeller, and the toy may be a UFO, a spinning disk, an airplane, a fairy, a Pegasus, a dinosaur, or a butterfly.

Consequently, contemplated kits include those comprising a carrier and a plurality of near-invisible fixed-length tethers, wherein each end of each of the tethers is releasably attached to the carrier via a low-tack adhesive such that a single one of the tethers is removable from the carrier without removing another one of the tethers. In especially preferred kits, the tethers are coupled to the carrier via a spool and have a length of between 20 and 100 cm.

Various objects, features, aspects and advantages of the present invention will become more apparent from the following detailed description of preferred embodiments of the invention, along with the accompanying drawing.

DETAILED DESCRIPTION

Figure 1A:
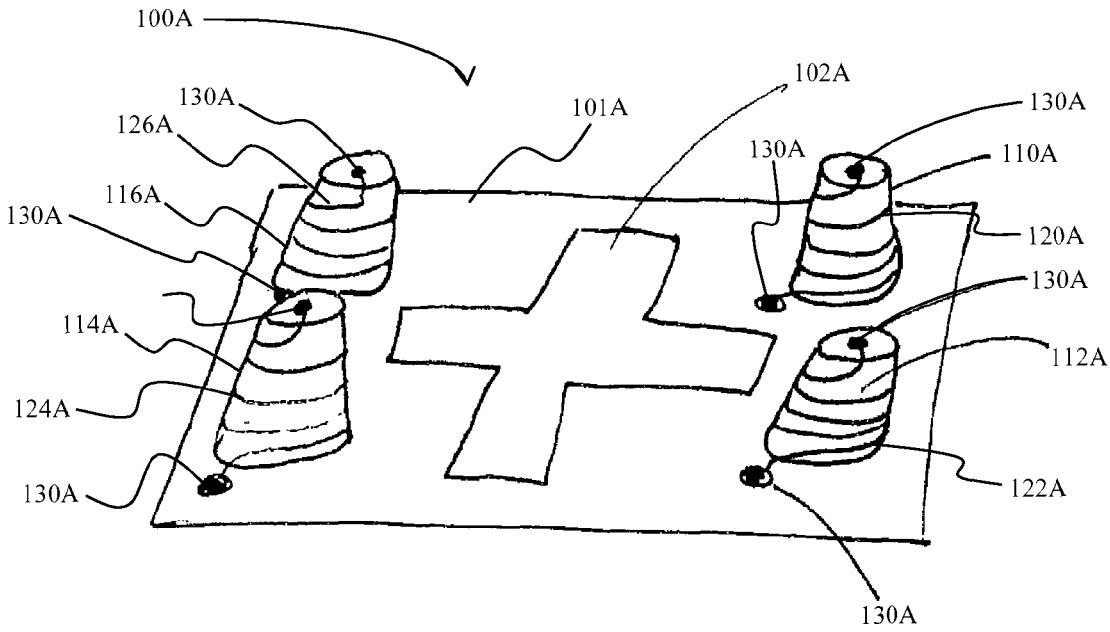
FIG. 1A depicts an exemplary tether carrier with multiple spools.

The inventors have discovered that numerous entertainment devices with near-invisible tethers can be made readily accessible to various users that would otherwise be precluded from such devices by providing a tether-spool assembly in which one or more tethers are held in a ready-to-use configuration. Most preferably, the tether is temporarily fastened to the spool using the same implement that also fastens the tether to the object and/or user. In still further especially preferred aspects, the object is relatively small (e.g., largest dimension less than 30 cm), and is a light-weight (e.g., less than 50 g) object. Among numerous other choices, particularly preferred light-weight objects include those having a mechanism that imparts appearance of plausible possibility of flight. Such appearance is typically implemented by one or more make believe propulsion and/or lift mechanisms (e.g., propeller, wing structure, etc.), wherein the mechanism is configured not to provide sufficient lift or propulsion for flight.

With respect to suitable tethers, it is generally preferred that the tether may be fabricated from numerous materials and combinations and may have a relatively wide range of thickness so long as such tethers have sufficient tensile strength to carry the weight of the object without breaking, and so long as such tethers are near-invisible to the unaided eye. Used in conjunction with a tether, the terms "near-invisible" and "near-invisible to the unaided eye" are interchangeable and refer to a tether that has a thickness of less than 300 micron, more typically less than 100 micron, even more typically less than 50 micron, and most typically between 5 and 50 micron. Most preferably, contemplated tethers have a dark color and are most typically black or dark blue and have a surface with low reflectivity (e.g., less than 20% of incident light is reflected).

While not limiting to the inventive subject matter, it is generally preferred that the tether will be a single filament or a small filament bundle of less than 10, and more typically less than 5 individual filaments, which is typically prepared from a larger yarn. For example, multifilament KEVLAR™ yarns (aramid yarn commercially available from EI Dupont de Nemours, Inc.) at 10 to 2000 Denier are typically suitable and can be separated into single filaments or small filament bundles. However, and where available, single filaments or small filament bundles may also be commercially obtained. Of course, it should be appreciated that the material is not limited to KEVLAR™, and numerous alternative materials (e.g., polyesters, polyamide, carbon fibers, etc.) are also deemed appropriate.

Regardless of the material and manner of production, it is contemplated that the near-invisible tether will be cut to a predetermined length, and most preferably multiple tethers to a set of predetermined lengths. In most circumstances, suitable tether lengths will be in the range of between 20 cm and 200 cm, and most typically between 30 cm and 100 cm. At least one of the tethers is then further modified on at least one end to facilitate storage, handling, and attachment to the object and/or user (or static structure such as a post, wall, ceiling, etc.). Particularly suitable modifications of the tether include terminal loops or other structures formed from the tether material to which the object and/or user (or static structure) can be fastened and/or non-tether material that facilitates coupling of the object and/or user (or static structure). In especially preferred aspects, the non-tether material comprises a low-tack material (e.g., poster putty commercially available from Elmer's Glue, Henkel, or 3M), a magnetic material, a small hook-and-loop fastener, a jewelry fastener (e.g., clasp, hook, carabiner clip, etc.), or other implement that allows reversible attachment of the end (and most preferably both ends) of the tether to the object and/or user (or static structure). In particularly preferred aspects, such implements will also retain or help retain the tether to the spool.

With respect to the spool it is contemplated that all structures are deemed suitable that allow temporary fastening of the tether to the spool, preferably such that removal of the tether from the spool will not result in entanglement of the tether. Therefore, particularly contemplated spools include 3-dimensional structures including cylindrical, frustoconical, (stepped) pyramidal structures, as well as generally flat structures, including triangle or square-shaped cards, all of which may be notched or otherwise shaped to maintain the tether in a predetermined position. For example, suitable alternative shapes of carriers include (notched) cards, elongated cylinders, irregularly shaped objects, and star-shaped objects, wherein each of these may have separate areas for receiving separate tethers. While not limiting to the inventive subject matter, it is typically preferred that the tether is wound to the spool such that one end of the tether is maintained on or near one end of the spool via the modified end (e.g., via poster putty) while the other end is maintained on or near the other end of the spool via the other modified end. Therefore, it should be appreciated that the tether can be released from the spool in a controlled manner and tangle-free manner such that one end can drop away from the spool while the other end of the tether is retained on the spool until the user removes that end as well. Thus, it should be noted that the term "spool" as used herein is not limited to a generally cylindrical structure but may have numerous geometries as exemplarily outlined above. It should also be appreciated that the carrier will preferably be configured to provide a fixed length of a tether without permanently retaining one end of the tether to the carrier (e.g., as is the case with a spring-operated spool that allows retracting the tether onto the spool).

Figure 1B:
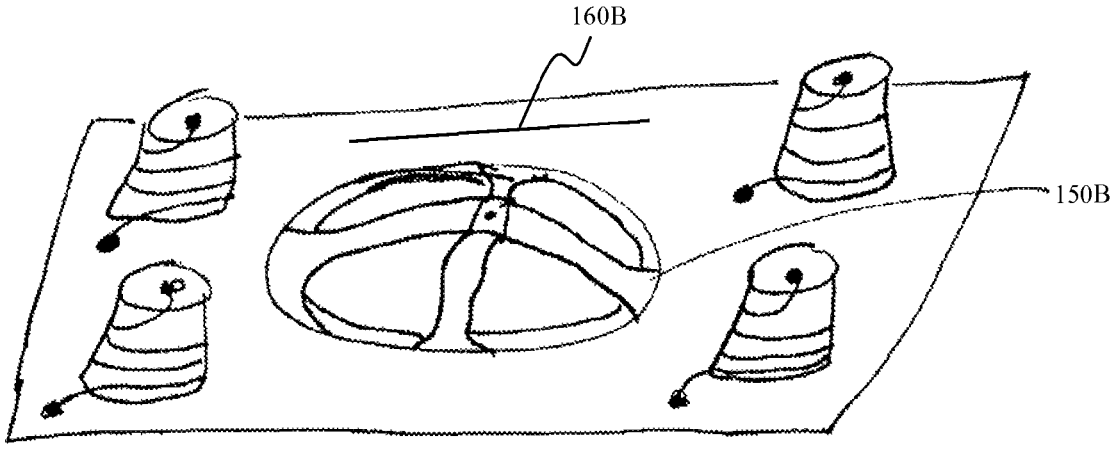
FIG. 1B depicts an exemplary tether carrier with an exemplary object coupled to the carrier.
Figure 1C:
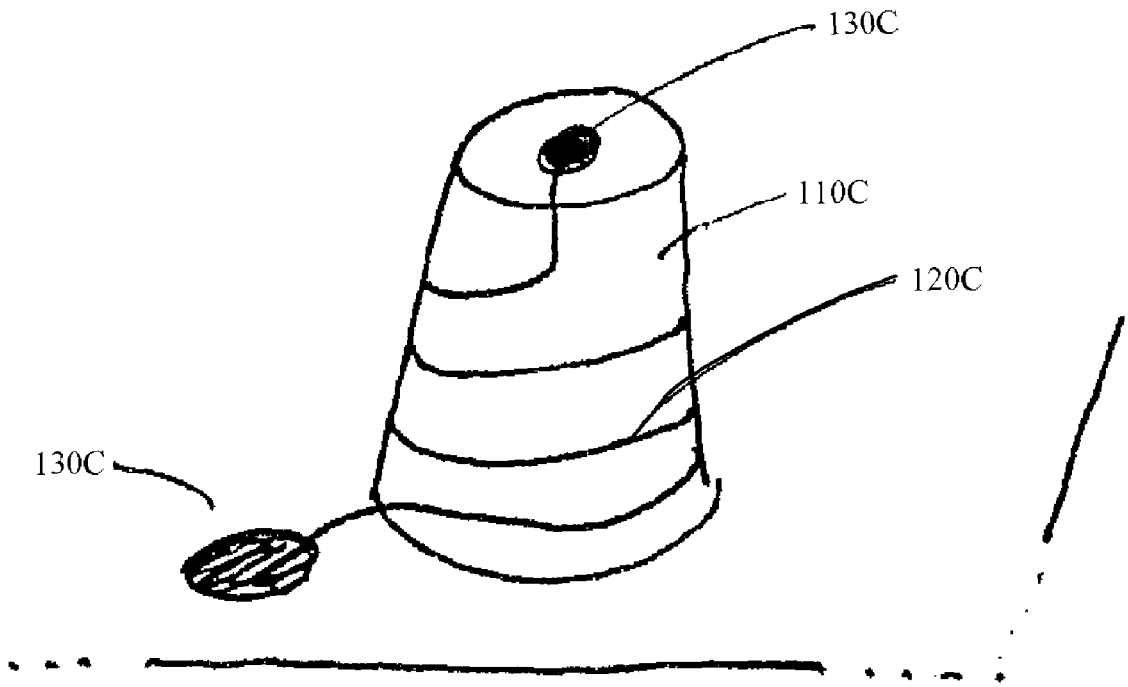
FIG. 1C is a detail view of one spool and tether with a low-tack material on one of the tether end.

In especially preferred aspects, a tether carrier includes multiple spools, each of the spools having one tether coupled thereto. As pointed out above, the tethers may have the same length of different lengths. While such carriers may be marketed by themselves, it is generally preferred that the carrier is configured to also retain at least a portion of the object that is to be coupled to the tether. FIG. 1A depicts an exemplary tether carrier 100A having a carrier body 101A with multiple spools 110A, 112A, 114A, and 116A. Wound around each of the spools are tethers 120A, 122A, 124A, and 126A, wherein each of the tethers is attached to the respective spool and the body via poster putty 130A. Carrier body 101A further includes a cutout 102 that is configured to accommodate a light-weight toy (not shown). FIG. 1B depicts the exemplary tether carrier of FIG. 1A, now with an exemplary light-weight toy (here: UFO 150B) coupled to the carrier via the cutout and a 'magic wand' 160B. FIG. 1C is a detail view of one spool 110C and tether 120C with a low-tack material 130C on each of the tether ends.

In yet further contemplated aspects of the inventive subject mater, one or more 'magic wands', typically configured as a simple rod or cylinder, optionally with a terminal modification (e.g., star, spark, light source, etc.) may be provided with the light-weight toy and/or tether to further increase play value. In such cases, the wand may be configured to allow reversible attachment of the tether and/or to allow contact of the wand with a portion of the tether between the ends of the tether. Consequently, it should be appreciated that the light-weight toy can be moved by a player by attaching one end of the tether to the player and the other to the toy while contacting the tether with the wand to so control movement of the toy. Alternatively, or additionally, one end of the tether may be attached to the wand while the other end is attached to the toy.

With respect to the object that is to be coupled to the tether it should be appreciated that numerous objects are suitable in conjunction with the teachings presented herein. However, it is particularly preferred that the object is relatively small and light-weight and has a mechanism that imparts appearance of plausible possibility of flight. As used herein, the term "mechanism that imparts appearance of plausible possibility of flight" refers to (a) any structure or implement that is recognized (i.e., of similar or identical appearance) as an element in a flying animate (e.g., bird, bat, insect) or inanimate (e.g., airplane, flying disc or ring) object, wherein that element imparts propulsion and/or lift to the animate or inanimate object, wherein (b) that structure or implement is proportioned and positioned in the light-weight toy such that sufficient lift or propulsion for flight of the toy appears possible. For example, one or more airfoils, propellers, or flapping wings are considered mechanism that imparts appearance of plausible possibility of flight. Most typically, movement of such mechanisms is provided by electromagnetic devices, including (stepping) motors, pumps, electromagnetic coil actuators, etc, all of which may be controlled by dedicated or combined control circuitry that is responsive to user input and/or position of the toy relative to a static surface (infra). In contrast, a design element labeled "antigravity thruster" or "jet pack" are not considered mechanism that imparts appearance of plausible possibility of flight.

For example, suitable objects include those having a propeller, fixed, flapping, and/or rotating wings, or a toy rocket engine that may or may not provide thrust, sparks, or other visual and/or audible effects. Thus, it should be particularly appreciated that suitable objects will have a first mechanism that simulates a lift and/or propulsion mechanism, but that such mechanism will not allow the object to maintain or increase altitude. Viewed from a different perspective, the first mechanism will merely provide a plausible possibility of lift and/or propulsion, but will not enable to object to fly in a predetermined manner using the first mechanism. In especially contemplated objects, a second mechanism is then used to impart a flying motion to the object, and it is particularly preferred that the second mechanism comprises the near-invisible tether. Typically, one end of the tether is coupled to the object using the modification on that end (e.g., loop or poster putty) while the other end is coupled to the user (e.g., via the modification to a piece of clothing). Consequently, it should be recognized that a user can move the object through the air in a flying and/or levitating motion, giving (and/or having) the impression of free flight of the object while the object is actually controlled via the tether. Viewed from a different perspective, it is now possible to impart flight capability to an object having a lift and/or propulsion mechanism that would otherwise not be able to fly using that lift and/or propulsion mechanism. Moreover, as the tether is already prepared for immediate use, even unskilled players will be readily able to enjoy contemplated entertainment devices and methods. The user simply disengages the tether from the carrier and attaches one end to the toy while the other end is attached to the user via the respective end modifications. Additionally, the toy may also be configured such that the toy has at least some controlled flight behavior (but still uses no propulsion and/or lift from the mechanism). For example, where the toy is a UFO, the UFO may be configured as a flying ring, a flying cylinder, or other toy that can be thrown along a trajectory.

Figure 2:
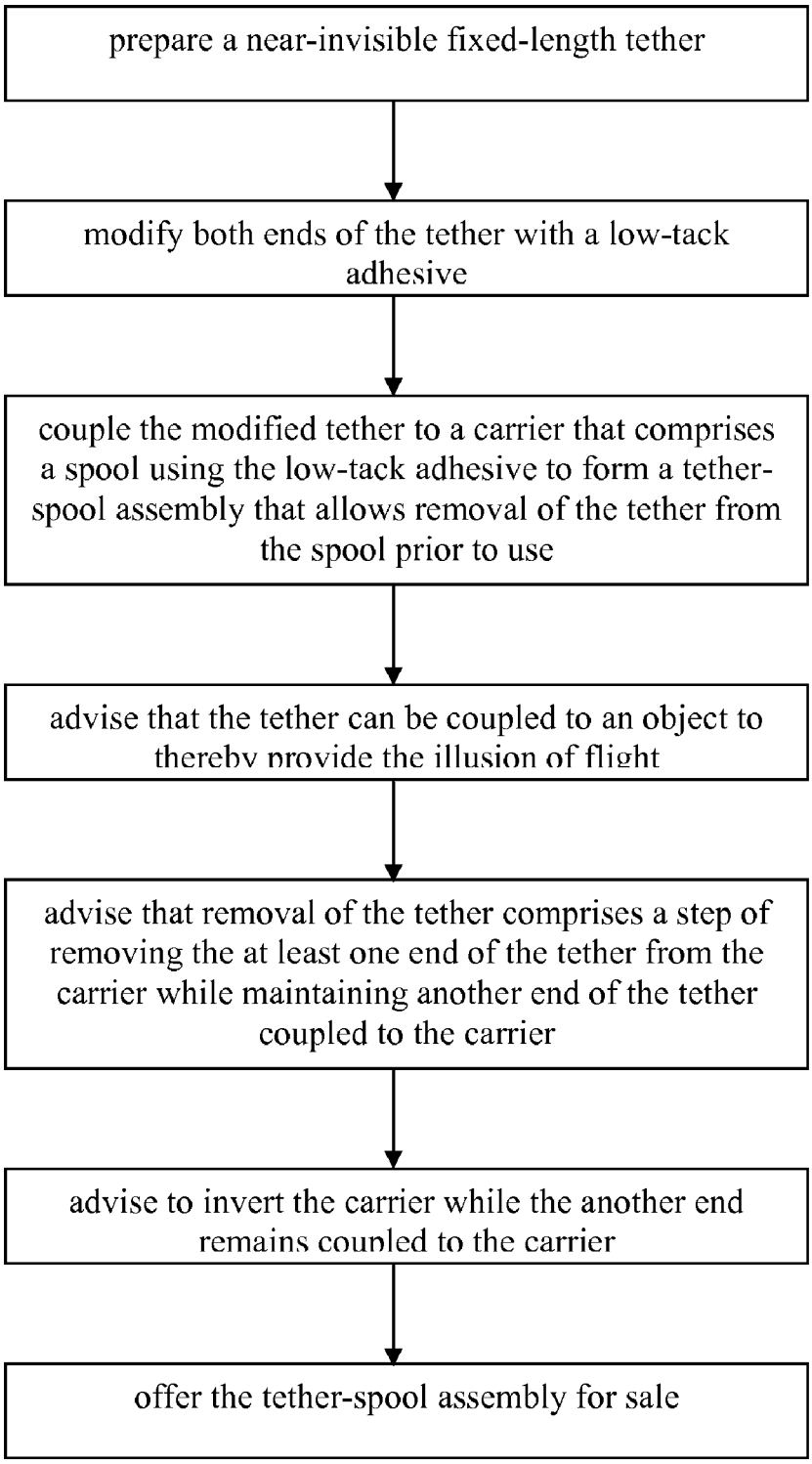
FIG. 2 is an exemplary method of reducing set-up time for an entertainment device.

FIG. 2 illustrates an exemplary method of reducing set-up time for an entertainment device comprising (a) preparing a near-invisible fixed-length tether, (b) modifying at last one end of the tether with a low-tack adhesive, (c) coupling the modified tether to a carrier that comprises a spool using the low-tack adhesive to form a tether-spool assembly that allows removal of the tether from the spool prior to use, (d) advising that the tether can be coupled to an object to thereby provide the illusion of flight, and (e) offering the tether-spool assembly for sale. Most typically, the step of preparation of the near-invisible fixed-length tether includes disassembly of a multifilament yarn into single filaments or bundles of filaments (e.g., between 2-15 filaments) to arrive at a tether that has a thickness of between about 5 and 200 micron, more preferably 10 and 100 micron, and most preferably between 10 and 50 micron. Alternatively, monofilaments may also be directly obtained from the yarn manufacturer. With respect to suitable lengths, it is generally preferred that the filament or filament bundle is trimmed to a length of between about 10 and 200 cm, more typically between 20 and 100 cm, and most typically between 40 and 90 cm to so obtain the near-invisible fixed-length tether. The tether materials are preferably selected such that the final near-invisible fixed-length tether has a tensile strength to support a toy having a weight of less than 2 g, more preferably less than 10 g, even more preferably less than 20 g, and most preferably less than 40 g.

Modification with the low-tack adhesive is preferably done by pressing one or both ends of the filament in respective small quantities (e.g., between 1-5 $mm^3$) of a low-tack adhesive so arrive at a tether that has sticky ends that are readily visible. Moreover, it is should be noted that the end-modification substantially straightens out the tether where the tether is held on one end on the carrier or other surface. Thus, the tether can be manipulated without otherwise readily occurring problems such as crimping, tangling, static cling, etc. Alternative modifications of the ends also suitable herein are described above. The modified tether is then typically wound around the spool or other structure, preferably such that inversion of the carrier, spool, or other structure will result in unwinding of the tether where one end of the tether has been removed from the carrier, spool, or other structure. The unwound tether is then preferably only retained by the carrier via the other modified end, which can simply be removed by peeling the adhesive from the carrier. That way, the tether is not only easily removed from the carrier, but also ready for use as both ends are suitable for attachment to the player and the light-weight toy.

In further contemplated methods, it is generally preferred to advise the user that removal of the tether can be done by removing one end of the tether from the carrier while maintaining the other end of the tether coupled to the carrier. In such case, the user may also be instructed to invert the carrier while one end of the tether remains coupled to the carrier (typically via the low-tack adhesive, but also via other mechanism, including compression fit into the carrier, tape, hook, etc.). Especially preferred carriers in contemplated methods are configured to receive at least a portion of a light-weight toy. For example, suitable configurations include cutouts, molded portions with corresponding shapes, etc., to so allow releasably coupling of the toy to the carrier. Alternatively, a light-weight toy may be simply co-packaged with the carrier. While not limiting to the inventive subject matter, it is preferred that the light-weight toy comprises a mechanism that imparts appearance of plausible possibility of flight to the toy without providing sufficient lift or propulsion for flight. For example, the mechanism may comprise a fixed airfoil, a movable airfoil, and/or a propeller, while the light-weight toy may be configured as a UFO (flying saucer), a spinning disk, an airplane, a fairy, a Pegasus, a dinosaur, and a butterfly. In still other aspects, the light-weight toy may comprise a puppet without the mechanism that imparts appearance of plausible possibility of flight.

While numerous other manners are also deemed suitable, the step of advising the user is preferably performed by providing a printed pictorial and/or a printed written information, and/or by providing an electronically displayed information (e.g., directly via Internet website or by providing a link to such site). Similarly, the tether-spool assembly may be offered for sale in numerous manners, however, particularly preferred avenues include the Internet, wholesale outlets, and retail sites. Consequently, the inventors also contemplate a kit that includes a carrier and a plurality of near-invisible fixed-length tethers, wherein each end of each of the tethers is releasably attached to the carrier via a low-tack adhesive in a manner such that a single one of the tethers is removable from the carrier without removing another one of the tethers. Most preferably (but not necessarily), the tethers in such kits have the same length and are coupled to the carrier via a spool, wherein the tethers have preferably a length of between about 10-150 cm, and most preferably a length of between about 20-100 cm.

Thus, specific embodiments and applications of compositions and methods related to near-invisible tethers have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A method of facilitating reduction of set-up time for a user using an entertainment device comprising:

(a) providing a near-invisible fixed-length tether having first and second ends and a thickness of less than 300 micron, (b) attaching to both ends of the tether a low-tack adhesive to thereby form a modified tether, (c) coupling both ends of the modified tether to a carrier that comprises a storage spool using the low-tack adhesive to form a tether-spool assembly that allows removal of the tether from the spool prior to use, and (d) wherein the user adhesively couples the first and second ends of the tether, after removal from the storage spool, via the low tack adhesive to a person and to an object, respectively, to thereby help the user to provide an illusion of flight of the object when the object is suspended in the air by the tether.

2. The method of claim 1 wherein the user removes one end of the tether from the carrier while maintaining another end of the tether coupled to the carrier.

3. The method of claim 2 wherein the user inverts the carrier while the another end remains coupled to the carrier.

4. The method of claim 1 wherein the carrier comprises a second storage spool with a second tether.

5. The method of claim 1 wherein the carrier is further configured to engagingly receive at least a portion of a light-weight toy, and wherein the light-weight toy is affixed to the carrier.

6. The method of claim 1 wherein the object is a light-weight toy, and further comprising a step of packaging the light-weight toy together with the carrier.

7. The method of any one of claim 5 or claim 6 wherein the light-weight toy comprises a mechanism selected from the group consisting of a fixed airfoil, a movable airfoil, and a propeller.

8. The method of claim 7 wherein the light-weight toy is configured as an object selected from the group of a UFO, a spinning disk, an airplane, a fairy, a Pegasus, a dinosaur, and a butterfly.

9. The method of claim 6 wherein the light-weight toy comprises an articulated puppet.

10. The method of claim 1 wherein the near-invisible tether has a diameter of less than 50 micron.

11. The method of claim 1 wherein the near-invisible tether has a length of between 30 cm and 100 cm.

12. The method of claim 1 further comprising a step of providing at least one of a printed pictorial information, a printed written information, and an electronically displayed information to thereby advise the user.

13. The method of claim 1 wherein the carrier has a cutout or molded portion having a shape corresponding to the object.

* * * * *